United States Patent [19]

Mulaskey

[11] 4,113,606

[45] Sep. 12, 1978

[54] METHOD OF REMOVING SULFUR-CONTAINING IMPURITIES FROM HYDROCARBONS

[75] Inventor: Bernard F. Mulaskey, Fairfax, Calif.

[73] Assignee: Chevron Research Company, San Francisco, Calif.

[21] Appl. No.: 727,488

[22] Filed: Sep. 28, 1976

[51] Int. Cl.[2] ..... C10G 29/04

[52] U.S. Cl. ..... 208/244; 208/246; 208/247

[58] Field of Search ..... 208/244, 246, 247, 245, 208/208 R, 243, 307, 300, 216 R

[56] References Cited

U.S. PATENT DOCUMENTS

| | | | |
|---|---|---|---|
| 3,051,646 | 8/1962 | Brooke | 208/245 |
| 3,267,025 | 8/1966 | Gring et al. | 208/216 R |
| 3,378,484 | 4/1968 | Ferrara et al. | 208/244 |
| 3,409,691 | 11/1968 | Small | 208/208 R |

*Primary Examiner*—George Crasanakis

*Attorney, Agent, or Firm*—D. A. Newell; R. H. Davies; D. L. Hagmann

[57] ABSTRACT

Sulfur-containing impurities are removed from a refined hydrocarbon feed by contact thereof with a porous sulfur-reactive agent having a pore volume of at least 0.15 cc per cc of which at least 5% is in pores having a diameter in the range 0.1 to 15 microns. The agent contains at least one sulfur-reactive material from the group copper, iron, zinc and compounds thereof.

7 Claims, No Drawings

METHOD OF REMOVING SULFUR-CONTAINING IMPURITIES FROM HYDROCARBONS

BACKGROUND OF THE INVENTION

This invention relates to a process for removing sulfur-containing impurities from a refined hydrocarbon feed. More particularly it relates to removing such impurities by contacting the feed with a novel material containing a sulfur-reactive agent and having a pore volume of at least 0.15 cc per cc of which 5% is in pores having a diameter in the range 0.1 to 15 microns.

In the refining of crude oil, product streams are obtained which contain a relatively minor amount of sulfur-containing impurities, for example thiols, thiophenes, hydrogen sulfide, organic sulfides, sulfur-containing heterocyclic organic compounds and the like. Such impurities reduce the desirability of a stream for many uses and may even make it unacceptable, for example as a feed to a naphtha reformer unit and the like. Contemporary anti-pollution standards greatly limit the amount of sulfur which may be present in any form in hydrocarbon fuels.

It is known to reduce the sulfur content of a refined hydrocarbon by contacting it with a material comprising a sulfur-reactive agent such as one comprising copper, iron, zinc and compounds thereof, especially where these materials are disposed upon an inert carrier material (see for example U.S. Pat. Nos. 2,755,226; 2,769,764; 3,192,152; 3,382,044; 3,441,370; and 3,660,276). A serious limitation of these materials is that the desired sulfur-removing reactions resulting from the contacting of the feed with the material are subject to diffusion limitations. In order to make a more effective use of the contact material in such a case, it is necessary to reduce the space velocity of the feed. This is disadvantageous because it lowers the capacity of the process unit involved.

SUMMARY OF THE INVENTION

An improved process has now been found for removing an impurity comprising sulfur from a refined hydrocarbon feed by contacting the feed with a sulfur-reactive agent under hydrocarbon sulfur-removing conditions. The improvement comprises employing a solid sulfur-reactive agent having a pore volume of at least 0.15 cc per cc of which at least 5% is in pores having diameters in the range of from about 0.1 to 15 microns.

In a more particular aspect, the sulfur-reactive agent is a novel composition comprising a rigidly interconnected pack of irregularly shaped particles, the pack having a pore volume of at least 0.15 per cc and having access channels among said particles throughout the pack, said channels comprising interconnected macropores having diameters corresponding to values as determined by mercury porosimetry in the range of from about 0.1 to about 15 microns, and said macropores contributing at least 5 percent of the pore volume; said particles being (1) of the same or different materials and (2) sized in the average diameter range below about 0.15 mm; and said particles comprising at least one material selected from the group consisting of (1) sulfur-reactive agents, (2) composites of said agents and at least one refractory oxide selected from the oxides of the metals of Groups II, III and IV of the Periodic Chart of the Elements, and (3) at least one of said refractory oxides; said composition containing at least about 1 weight percent of said sulfur-reactive agent and having a surface area in the range of from about 2 to 700 square meters per gram.

PREPARATION OF CONTACT MATERIAL

The contact material required for the process of the invention may be obtained by any suitable way. In a preferred method this material is prepared by a unique process in which (1) the material in finely divided form (particles of diverse sizes having diameters in the range below 0.04 mm) is admixed with a hydrocolloid-forming organic compound, for example wheat flour, and water to form an extrudable dough-like mass, (2) the mass is then extruded, for example by using a 2.5 mm orifice and (3) dried.

Broadly, the drying may be effected by any suitable means for removing water from the composite. Heating thereof at an elevated temperature, for example in the range of between 50° to 700° C. in an oxygen-containing gas, for example air, or in an inert atmosphere, for example, nitrogen gas, is, in general, satisfactory. When the heating is at a temperature below about 200° C. or with the composite blanketed by an inert atmosphere in the range 200° C. to 700° C., the resulting composite usually contains residual carbonaceous material. The latter composite is a preferred contact material because of its usually superior crush strength relative to the case where the drying is effected in air or an oxygen-containing gas under a combusting temperature in the range above 200° C. to 700° C.

Based upon the finely divided material, about 2–10 weight percent of the organic compound and sufficient water to form an extrudable mass are used in the preparation. The resulting product has an appreciable pore volume of which at least 5% is in pores sized in the 0.1 to 15 micron diameter range. Pores of these dimensions are excellent access pores for the hydrocarbon feed.

EMBODIMENT

In a preferred embodiment a naphtha boiling range fraction obtained from the hydrocracking of a suitable distillate feed is treated by the process of the invention. A representative hydrocrackate feed has a boiling point in the range 93° C. to 177° C. and has a sulfur content, calculated as elemental sulfur, in the range 15 to 250 ppm. Such a hydrocrackate, because of its sulfur content, is undesirable for many purposes, for example as a feed to a reformer employing a platinum-rhenium-containing reforming catalyst. In the treatment, the hydrocrackate feed is contacted at an elevated temperature of about 165° C. at a liquid hourly space velocity of about 10 with a contact mass comprising a mixture of copper chromite and fluid catalytic cracking (FCC) catalyst fines, for example electrostatically precipitated fines normally recovered in a hydrocarbon catalytic cracking process. These fines are normally submicron sized and usually, but not necessarily, are a composite of an amorphous silica-alumina matrix and a crystalline aluminosilicate, i.e., zeolitic molecular sieves, suitable as a cracking catalyst component. In the preparation of the contact mass as described above, proportion, in parts by weight, as follows are desirably used:

| | |
|---|---|
| FCC fines | 27 |
| Copper Chromite (powdered) | 27 |
| Wheat Flour | 10 |
| Water | 36 |

The resulting product stream has a sulfur content of less than 0.1 ppm and is an excellent feed for a reformer unit.

In a further embodiment, a porous copper-containing contact material herein is used as a guardbed for a hydrocarbon reformer unit, for example where a hydrotreated hydrocarbon feed stream is stripped in a gas stripping unit for the removal of hydrogen sulfide prior to use as feed to the reformer. Normally, the stripping procedure is effective. However, inadvertent upsets and misadventures are known to have occured with serious consequences in the operation of the reformer unit, for example temperature excursions, impairment of catalyst selectivity and activity and as a result reduced aromatic content in the product. The bottom effluent from the stripper unit is normally a liquid at a temperature in the range 20° to 50° C. This liquid is introduced into contact with the porous contact material herein in a fixed bed at a liquid hourly space velocity (LHSV) of at least 10. Even at the relatively low temperatures noted above any hydrogen sulfide present in the stripper bottom effluent is effectively removed from the feed streams. Because of the relatively high content of 0.1 to 15 micron macropores in the contact mass, relatively high LHSV's may be advantageously used with guardbed unit without diffusion limitation problems and without risk of hydrogen sulfide carryover into the reformer unit.

PROCESS FEED

Refined hydrocarbons having a sulfur-containing impurity content, calculated as elemental sulfur, in the range of from about 1 to 2000 ppmw are especially satisfactory for use as process feeds herein and such use is contemplated.

By refined hydrocarbons as used herein, is meant by definition liquid and gaseous hydrocarbons and mixtures thereof normally obtained as primary or secondary products in the processing of sulfur-containing petroleum oils and gas in a petroleum refinery or the like and containing, calculated as elemental sulfur, at least about 1 ppm (weight) of sulfur-containing impurities and less than about 2000 ppm thereof. Larger relative amounts of the inpurity may be present and are effectively removed. However, there are usually more economic means for treating such than by the process herein.

Representative refined hydrocarbons include distillate fractions such as gas oil, hydrocrackate and catcracker oils, gasoline, kerosene, jet and diesel fuels and fractions thereof, and the like which have a sulfur-containing impurity content in the range from 1 to about 2000, preferably 5 to 500 ppmw.

CONTACT MASS

A contact mass satisfactory for use in the process of the invention and contemplated for use herein must be a solid comprising a sulfur-reactive agent which has at least an appreciable (at least 0.15 cc per cc) pore volume of which at least 5% is in access pores, that is, in pores having a diameter in the 0.1 to 15 micron range.

By a sulfur-reactive agent as used herein is meant by definition the metals copper, iron and zinc, mixtures thereof and compounds of the metals which react with hydrogen sulfide and alkyl mercaptans under the process conditions herein to form the corresponding metal sulfide and metal mercaptide and their composites with refractory metal oxides. Preferably, the contact solid comprises at least one sulfur-reactive agent selected from the group consisting of the metals copper, iron, and zinc, their sulfide- and mercaptide-forming compounds, and their composites comprising the agent(s) and at least one refractory oxide selected from the oxides of the metals of Groups II, III and IV of the Periodic Chart of the Elements.

Representative sulfur-reactive agents include copper, iron and zinc; copper, iron and zinc oxides; copper, iron and zinc salts, such as copper chloride, copper acetate, copper carbonate, copper chromite and the like copper salts; and iron and zinc carbonate and the like salts. The metals and metal oxides and composites thereof with one or more refractory metal oxides are preferred sulfur-active agents, especially in the form of the particle packs described supra.

Where the contact mass is a composite of a sulfur-reactive agent and a refractory oxide, the amount of the agent present in the composite mass may vary widely depending in general upon the service in which it is to be employed. In general, a satisfactory amount, based upon the refractory oxide and calculated as the metal fraction of said agent, will be in the range from about 1 to 25 weight percent. Best results are believed to obtain when the amount is in the range 5 to 20 weight percent. Contact masses containing a refractory oxide component as herein may be prepared by any suitable method. Again, the preferred method is pursuant to the process described above in which a particle pack is produced and in which (1) the finely divided refractory oxide solid contains the sulfur-active agent disposed therein; (2) both the refractory oxide and the sulfur-active agent are finely divided solids of the described dimensions; or (3) finely divided refractory oxide material in the absence of a sulfur-active agent is converted to suitable porous material which is then impregnated with the sulfur-active agent or a suitable precursor thereof by customary impregnation methods, for example by immersion of the porous solid in an aqueous solution of a copper salt followed by drying and calcination.

A contact mass suitable for use herein must have a substantial pore volume, for example at least 0.15 cc per cc and a substantial surface area for effective utilization of the sulfur-reactive agent. Pore volume and surface area characteristics vary depending in the main upon the sizing of the pores constituting the pore volume. In general, a satisfactory contact mass will have a pore volume in the range 0.15 to 0.8 cc per cc and higher and a suface area in the range of from about 2 to 700 $m^2$ per gram, preferably 20 to 300 $m^2/g$.

In order to provide effective access of the hydrocarbon feed to the sulfur-reactive agent and to avoid diffusion limitation problems, the contact mass must contain a substantial fraction of its pore volume in access pores having diameters in the range of from about 0.1 to 15, preferably 1 to 10 microns. In general, a satisfactory fraction will be in the range of from about 5 to 45% of the pore volume. The lower relative amounts of access pores relate to solid contact masses having relatively high pore volumes, and the higher relative amounts correspond to masses having relatively lower pore volumes.

The contact mass herein may have any suitable size. Desirable sizing varies, in general, depending upon whether the contacting is carried out in a fixed bed, fluid bed or slurry of liquid and solid, for example for fixed bed usage in the usual average diameter range of from about 0.8 to 13 mm, and for fluid a slurry usage in the average diameter range below about 0.8 mm.

SULFUR-REMOVING REACTION CONDITIONS

Satisfactory sulfur-removing reaction conditions vary widely, depending upon the particular contact mass employed, the particular kind and amount of the sulfur-containing impurity involved, upon the pore volume and pore size distribution of the contact mass and the like factors. In general, these conditions include:

| Condition | Broadly | Preferred |
|---|---|---|
| Temperature, ° C | 10 to 425 | 50 to 350 |
| Pressure, atm | 1 to 100 | 1 to 10 |
| LHSV, V/V/hr | 1 to 25 | 5 to 20 |
| Hydrogen Pressure, atm | 0 to 100 | 0 to 50 |

The following examples are provided for the further illustration of the process of the invention but not the limitation thereof.

EXAMPLES 1-16

In the examples to follow porous composites were prepared by mixing water, an organic binder and one or more sulfur-reactive agents. All solids used were in the form of powders. The resulting mixtures were extruded and dried at about 135° C. The kinds and relative amounts of the materials used in preparing the mixes are listed in Table I.

TABLE I

| Ex. No. | Organic Binder & wt. % (Dry Basis) | $H_2O$ wt. % of mix | Copper or Cu CPD. & wt. % (Dry basis) | Other Additive, % wt. % (Dry basis) |
|---|---|---|---|---|
| 1 | Flour,10 | 37.5 | Chromite,90 | |
| 2 | Flour,20 | 33.3 | Chromite,80 | |
| 3 | Flour,20 | 33.3 | Carbonate,80 | |
| 4 | Flour,10 | 23.7 | Carbonate,90 | |
| 5 | Flour,20 | 29.1 | Carbonate,80 | |
| 6 | Flour,30 | 28.6 | Oxide,53 | Zinc oxide,17 |
| 7 | Flour,30 | 28.6 | Oxide,12 | Zinc oxide,38 |
| 8 | Flour,10 | 7 | Metal,90 | |
| 9 | Flour,10 | 13 | Metal,90 | |
| 10 | Flour,9 | 19.4 | Chloride(I), 83 | Celite,7.5 |
| 11 | Xanthan gum,2 | 25.4 | Oxide,73.5 | Alumina,24.5 |
| 12 | Flour,10 | 42.5 | Chromite,90 | |
| 13 | Flour,10 | 44.4 | Chromite,45 | Alumina,45 |
| 14 | Flour,10 | 45 | Chromite,22 | Alumina,68 |
| 15 | Xanthan gum,3 | 25.3 | Oxide,73.5 | Alumina,24.5 |
| 16 | Copolymer[1],20 | 64 | Chromite,80 | |

[1]Methylvinylether-Maleic anhydride copolymer

Representative composites from Examples 1-16 above were examined to determine for each its amount of (1) pores having an average pore diameter below $10^3$ Angstroms, (2) pores having an average pore diameter above $10^3$ Angstroms, and (3) surface area. These were determined using the mercury porosimetry method in the usual way. In the interpolation of the data a contact angle of 2.443461 radians and a surface tension of 473.000 dynes per cubic centimeter were used. The results are listed in Table II.

TABLE II

| Ex. No. | Total Pore VCL, cc/g | Pore Dia. $<10^3$ A., % of Pore Volume | Pore Dia. $<10^3$ A., % of Pore Volume | Surface area, $m^2/g$ |
|---|---|---|---|---|
| 12 | 0.52 | 25 | 75 | 20 |
| 13 | 0.63 | 59 | 41 | 101 |

TABLE II-continued

| Ex. No. | Total Pore VCL, cc/g | Pore Dia. $<10^3$ A., % of Pore Volume | Pore Dia. $<10^3$ A., % of Pore Volume | Surface area, $m^2/g$ |
|---|---|---|---|---|
| 14 | 0.67 | 64 | 36 | 141 |
| 15 | 0.25 | 55 | 45 | 49 |

The compositions prepared in Examples 1-16 are representative of contact masses which are rigidly interconnected packs of irregularly shaped particles. These compositions contain materials and have pore volumes, access pore contents and sizes and surface areas which are especially suitable for effectively removing impurities comprising sulfur from refined hydrocarbon feedstocks.

What is claimed is:

1. In a process for removing an impurity comprising sulfur from a refined hydrocarbon feed by contacting said feed with a metal sulfide- and mercaptide-forming agent under sulfide- and mercaptide-forming conditions, thereby forming a metal sulfide and/or mercaptide, the improvement comprising employing as said agent a rigidly interconnected pack of irregularly shaped particles, said pack having a pore volume of at least 0.15 cc per cc and having access channels among said particles throughout said pack, said channels being interconnected macropores having diameters, as determined by mercury porosimetry, in the range of from about 0.1 to about 15 microns, and said macropores contributing at least 5 percent of said pore volume; said particles of said pack being (1) of the same or different materials and (2) sized in the average diameter range below about 0.15 mm; and (3) composed of at least one material selected from the group consisting of (a) the metals copper, iron and zinc and sulfide- and mercaptide-forming compounds of said metals, (b) composites of at least one of said metals and compounds in (a) with at least one refractory oxide selected from the oxides of the metals of Groups II, III and IV of the Periodic Chart of the Elements and (c) at least one of said refractory oxides; said pack (1) having a surface area in the range of from about 2 to 700 square meters per gram, and (2) containing at least one weight percent of said at least one material listed in 3(a) above.

2. A process as in claim 1 wherein (1) said particles of said pack are composed of materials selected from the group consisting of said composites and (2) said pack contains, based upon said refractory oxide and calculated as the metal, an amount of said at least one material of group 3(a) in the range of from about 1 to 25 weight percent.

3. A process as in claim 2 wherein said amount is in the range of from about 5 to 20 percent.

4. A process as in claim 1 wherein said feed has a sulfur-containing impurity content, calculated as sulfur, in the range of from about 1 to 2000 ppmw.

5. A process as in claim 1 wherein said surface area is in the range of from about 20 to 300 square meters per gram.

6. A process as in claim 1 wherein an amount of said pore volume in the range of from about 5 to 45 percent is in said pores having diameters in the 0.1 to 15 micron range.

7. A process as in claim 1 wherein said feed is a hydrotreated reformer feedstock and said contacting of the feedstock by said agent provides a sulfur-impurity guardbed for said reformer.

* * * * *